US005326145A

United States Patent [19]

Lee

[11] Patent Number: 5,326,145

[45] Date of Patent: Jul. 5, 1994

[54] GOLF BALL RETRIEVER

[76] Inventor: Do J. Lee, 2416 Winterstone, Plano, Tex. 75023

[21] Appl. No.: 156,703

[22] Filed: Nov. 24, 1993

[51] Int. Cl.[5] ..... A63B 47/02

[52] U.S. Cl. ..... 294/19.2

[58] Field of Search ..... 194/19.1, 19.2, 99.1; 56/327.1, 328.1, 332; 273/32 F, 162 E

[56] References Cited

U.S. PATENT DOCUMENTS

| | | | |
|---|---|---|---|
| 373,289 | 1/1887 | Hart | 294/19.1 X |
| 1,431,968 | 10/1922 | McDermott | 294/19.2 |
| 1,452,679 | 4/1923 | Fisher | 294/19.2 |
| 2,270,632 | 1/1942 | Hasty | 294/19.2 |
| 2,549,257 | 4/1951 | Staunt | 294/19.2 |
| 2,972,851 | 2/1961 | Goehring | 294/19.2 X |
| 3,265,430 | 8/1966 | Jenkins | 294/19.2 |
| 3,743,338 | 7/1973 | Seeger | 294/19.2 |
| 3,866,965 | 2/1975 | Homeier | 294/19.1 |
| 4,046,413 | 9/1977 | Jeninga | 294/19.2 |
| 4,254,981 | 3/1981 | Wilson | 294/19.2 |
| 4,322,939 | 4/1982 | McDonald | 294/19.2 X |
| 4,334,707 | 6/1982 | Phillips | 294/19.2 |

FOREIGN PATENT DOCUMENTS

| | | | |
|---|---|---|---|
| 270206 | 5/1966 | Australia | 294/19.2 |

*Primary Examiner*—Johnny D. Cherry
*Attorney, Agent, or Firm*—Richard C. Litman

[57] ABSTRACT

A golf ball retriever enables a golfer to quickly and easily recover the ball from a muddy ground hazardous location and the like. The retriever includes a rod, a swivel coupling adjustably mounted on the rod for positioning the retriever at selective angular positions with respect to the ground, a head member fixedly attached to the swivel coupling, and a cage mounted on the head member for capturing a single ball or multiple balls within, depending on the size of the cage being used. The retriever cage is formed of flexible looped wires which are spaced apart sufficiently to permit passage of the ball therein. The ball is captured by contacting the ball with the cage in a direct or peripheral manner. Cages of various capacities can be readily interchanged on the retriever.

4 Claims, 4 Drawing Sheets

GOLF BALL RETRIEVER

BACKGROUND OF THE INVENTION

1. Field of the Invention

The present invention relates to a golf ball retriever which enables a golfer to quickly and easily recover the ball which is lodged in a muddy ground hazardous location and the like. More particularly, the present invention pertains to a golf ball retriever having wire loop projections from the front end of an elongated handle, including one wire loop used as a retaining element for loosely engaging the other wire loops.

2. Description of the Prior Art

Retrievers for golf balls are known in the prior art. Many of the golf ball retrievers of the prior art require the golfer to have a substantial amount of patience and luck to actually capture the ball within a cage of the retriever. In a water hazardous situation, unclear water and/or wave movement on the water surface make(s) the retrieval uncertain of success. Many golfers find it extremely difficult to position the cage securely on top of the ball to perform the retrieval, especially if the ball is located in a muddy hole in the water hazardous location and the like. Further, when the handle of the retriever is a long telescopic type, that is, when the telescopic handle is extended to its operational length, that is, 10 feet, 15 feet, 18 feet and the like, the cage end becomes shaky and difficult to retain in a stationary position to enable the ball to be contacted. Further, mispositioning of the cage can agitate the water and give it a muddy and unclear condition to make the retrieval difficult or impossible. Further, retrievers of the prior art are difficult to operate when the retrieval operation is performed in a tight and small space. When a ball rolls, for example, into a small hole at a water hazardous location, the wedging of the ball into the cage enclosure and its retention therein are challenges which have met with little or no success by the prior art devices. Eventually, the golfer may give up trying to retrieve the ball and will move on in an angry mood which may not help the golfer's game.

Retrievers are broadly old in the patented prior art as illustrated in the references cited below.

The U.S. Pat. No. 373,289 issued Nov. 15, 1887 to William H. Hart discloses the feature of interchangeability of tools on a rod member.

U.S. Pat. No. 2,270,632 issued Jan. 20, 1942 to Robert R. Hasty discloses a golf ball rake or retriever comprising a telescoping handle and a cage which are adjustable to various angular positions with respect to each other.

U.S. Pat. No. 3,265,430 issued Aug. 9, 1966 to Homer T. Jenkins discloses a golf ball retriever comprising a retriever unit pivotally connected to a handle portion. The retriever unit having a wedging part of opposed members collects the ball by passing the ball through a pair of adjoining, resilient members to retain the ball therein.

U.S. Pat. No. 3,743,338 issued Jul. 3, 1973 to Robert W. Seeger discloses a golf ball retriever which is adapted to be removably attached to the end of an elongated rod. The retriever head comprises a plurality of elongated wires shaped into loops, which are secured within a tubular hub to form a cage-like structure. Upon contact with the ball, the opening of the loop is slightly expanded to receive the ball and then closes around the ball once it is within the cage-like structure.

Australia Patent No. 270,206 published May 12, 1966 to Kenneth E. Graham discloses a golf ball retriever having a cage-like member of a cylindrical formation of a diameter slightly larger than the ball.

None of the above-cited patents disclose or suggest alone or in combination the instant invention described and claimed herein.

SUMMARY OF THE INVENTION

The present invention relates to a golf ball retriever which enables a golfer to quickly and easily recover the ball from a muddy ground hazardous location and the like. The retriever includes a handle, a swivel coupling adjustably mounted on the handle for positioning the retriever at selective angular positions with respect to the ground, a head member fixedly attached to the swivel coupling, and a cage mounted on the head member for capturing a single ball or multiple balls within, depending on the size of the cage being used. The retriever cage is formed of flexible looped wires which are spaced apart sufficiently to permit passage of the ball therein. The ball is captured by contacting the ball with the cage in a direct or peripheral manner. Cages of various capacities can be readily interchanged on the retriever.

Accordingly, it is an object of the invention to provide a golf ball retriever for enabling a golfer to recover the ball from a muddy ground hazardous location, sticky brush area, and the like.

It is a further object of the invention to provide a golf ball retriever wherein various sized cage units may be used, depending on the number of balls to be captured.

It is a still further object of the invention to provide a golf ball retriever which will enable a golfer to manually adjust the retriever at selective angular positions with respect to the ground whereby the ball may be easily retrieved from the hazardous location.

Another object of the invention is to provide a golf ball retriever which will easily enable a golfer to retrieve a ball which is lodged in a small and tightly confined hazardous location.

Another object of the invention is to provide a golf ball retriever which is easily carried within any conventional golf club bag.

Another object of the invention is to provide a golf ball retriever which is easy to construct and maintain in view of the minimum of parts in the instant invention.

Another object of the invention is to provide a golf ball retriever which enables a golfer to contact the lodged ball with a minimum contact portion of the cage and thereby the ball is quickly retrieved and captured within.

Other objectives of the present invention will be apparent from the following detailed description of the invention.

BRIEF DESCRIPTION OF THE PREFERRED EMBODIMENTS

Figure 1:
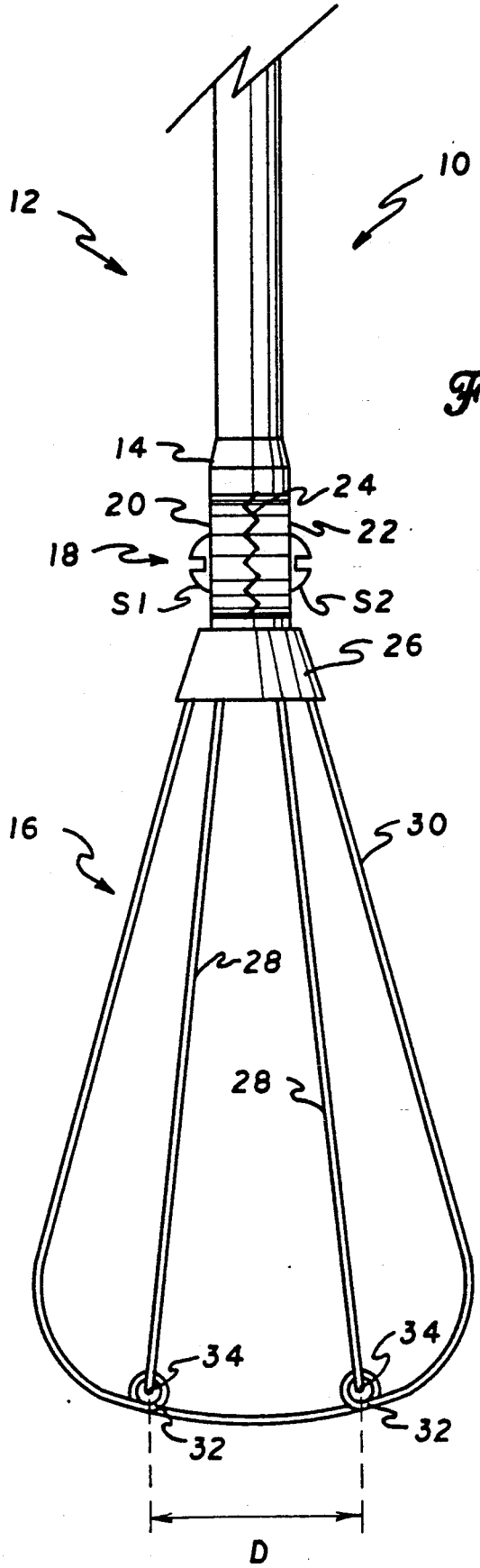
FIG. 1 is a side view of a first embodiment of the golf ball retriever for capturing a single golf ball at one time.
Figure 3:
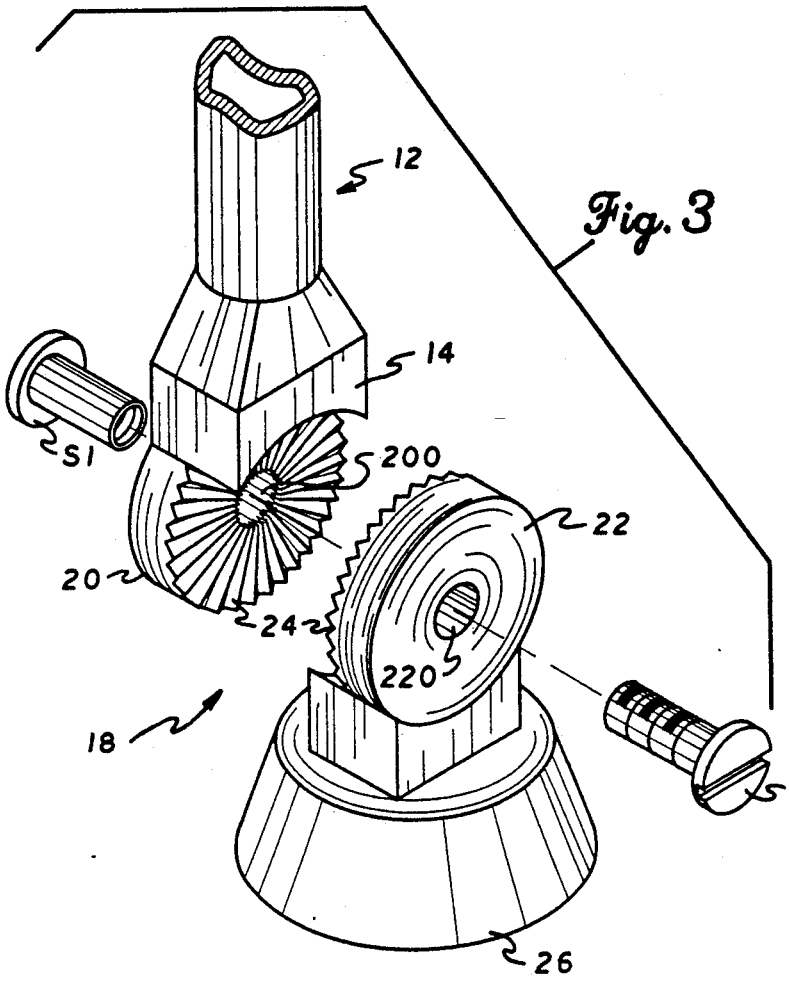
FIG. 3 is a side exploded partial perspective view of the golf ball retriever emphasizing the retriever's angle adjustment feature for the cage relative to the elongated handle.

FIG. 1 shows a golf ball retriever 10 including an elongated handle 12 having a front end 14 to which a cage element 16 is attached through the use of a swivel attachment 18. The swivel attachment 18 includes two circular disc members 20 and 22 having mated grooved portions 24 for providing a pivotal attachment between the cage element 16 and the elongated handle 12. The details of the swivel attachment 18 are shown in FIG. 3 and discussed in more detail below.

As shown in FIG. 1, the cage element 16 includes a head portion 26 having two flexible individual looping members 28 extending from the front of the head portion 26. Each of the flexible individual looping members 28 is an elongated flexible wire with the ends embedded into the front of the head portion 26. A retaining flexible loop element 30 also extends out from two opposite sides of the head portion 26 and includes two engaging loops 32, each one enclosed about one of the flexible individual looping members 28 at a distal portion 34 thereof located at a greatest distance from the head portion 26 along the outer edge of the cage element 16 opposite the head portion 26.

The distance D between the distal portions 34 is slightly less than the diameter of a regulation golf ball. Each of the individual flexible individual looping members 28 forms a capturing loop bounded by the outer periphery thereof, which is the flexible wire embedded into and extending out from the head portion 26. Since the distance D between the distal portions 34 is slightly less than the diameter of a regulation golf ball, a single golf ball may be retained between the capturing loops.

Figure 2:
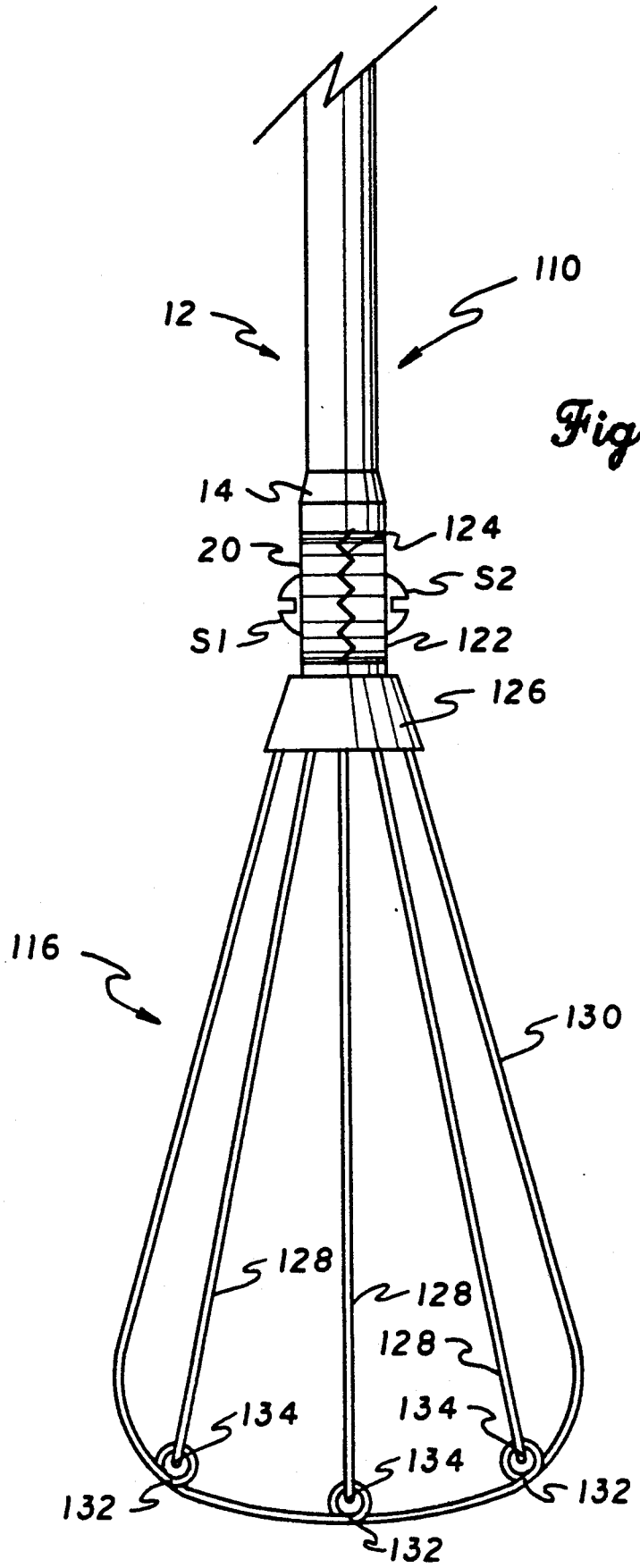
FIG. 2 is a side view of a second embodiment of the golf ball retriever for capturing more than one golf ball at one time.

A second embodiment as shown in FIG. 2 includes three flexible individual looping members 128 and is capable of retaining more than one regulation sized golf ball. More particularly, the golf ball retriever 110 includes the same elongated handle 12 as used in the golf ball retriever 10, but having a larger cage element 116 attached thereto instead of the cage element 16. The specifics of the swivel attachment 18 allowing different cage elements to be attached to the elongated handle 12 will be discussed in greater detail below. Briefly, for the present discussion of the second embodiment illustrated in FIG. 2, the circular disc 20 is attached rigidly to the front end 14 of the elongated handle 12 and the circular discs 22 and 122 are rigidly attached to head portions of their respective cage elements 16 and 116. The screws S1 and S2 allow the disc portions to be disengaged from their mated grooved portions 24 or 124 so that another cage element may be attached to the elongated handle 12.

The cage element 116 includes three flexible individual looping elements 128 extending from the head portion 126. Each of the flexible individual looping elements 128 is an elongated wire with the ends embedded into the front of the head portion 126 to form a capturing loop to trap a regulation sized golf ball between any two capturing loops of the individual looping elements 128. A retaining flexible loop element 130 extends out from the head portion 126 and includes three engaging loops 132, each one enclosed about one of the flexible individual looping members 128 at a distal portion 134 thereof located at a greatest distance from the head portion 126 along the outer end of the cage element 116 opposite the head portion 126. As in the first embodiment, the distance between any two distal portions is slightly less than the diameter of a regulation sized golf ball.

Figure 4:
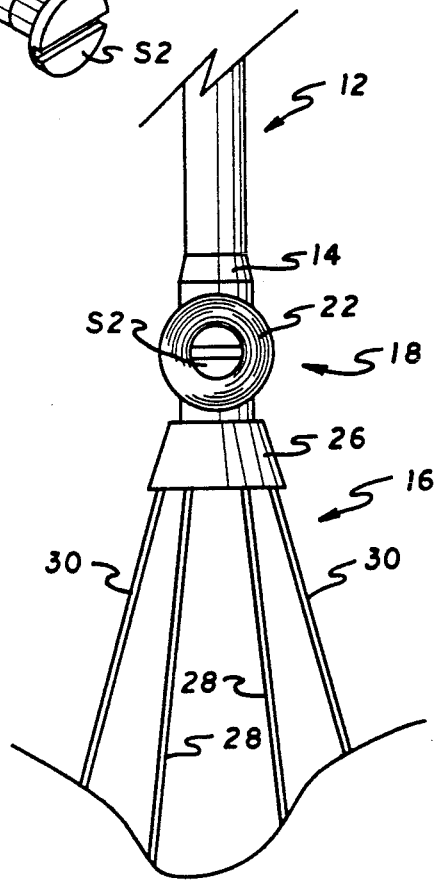
FIG. 4 is a partial side view of the angle adjustment feature of the golf ball retriever.

As shown in FIG. 3, the swivel attachment 18 for the golf ball retriever 10 having the cage element 16 attached to the elongated handle 12 includes a conventional internally threaded screw nut S1 and a conventional outwardly threaded screw bolt S2. The circular disc 22 is attached to the head portion 26 of the cage element 16 and includes a hole 220 therethrough allowing the screw S2 to be inserted therein. The circular disc 20 is attached to the front end 14 of the elongated handle 12 and includes a hole 200 through which the screw S1 may be inserted. The swivel coupling 18 provides the capability of angularly adjusting the longitudinal direction of the elongated handle 12 relative to the direction at which the flexible individual looping members 28 extend from the head portion 26. There are many discrete positions at which the mated grooved portions 24 match so that there are no gaps between the circular disc members 20 and 22 (see FIG. 1). For example, FIG. 4 illustrates an angular adjustment of the swivel attachment 18 with the elongated handle 12 and the head portion 26 adjusted such that the longitudinal direction of the elongated handle 12 is collinear with the direction the elongated members 28 extend from the head portion 26. The swivel attachment of the golf ball retriever 110 functions in a similar manner to attachment 18.

Accordingly, such factors as the contour of the ground and the like, will determine what angular adjustment should be made between the head portion 26 or 126 relative the elongated handle 12 or 112. Further, if a golfer needs to retrieve a golf ball from a tight area, he may choose the smaller cage element 16 to retrieve the golf ball, while if the golfer needs to retrieve the golf ball in an area where the exact location of the golf ball may be hard to determine, the golfer may choose the larger cage element 116 to accomplish the task. These and other advantages of the present invention will be discussed below in conjunction with FIGS. 5–7.

Figure 5:
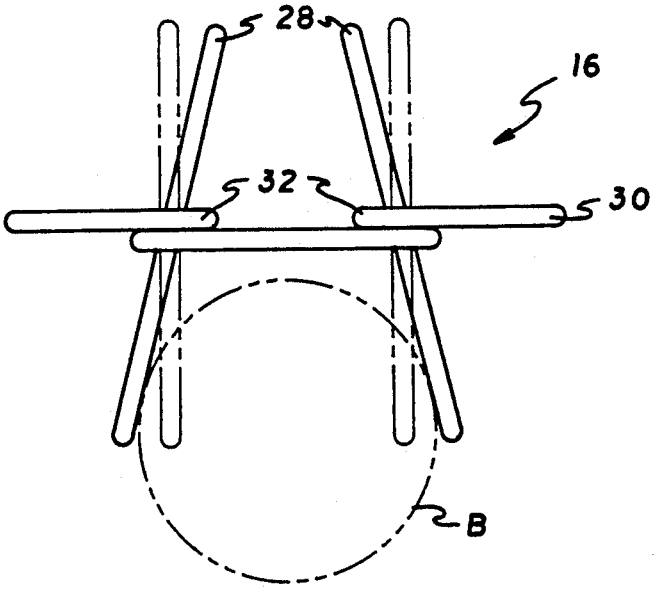
FIG. 5 is a partial front view of the cage element of the first embodiment.

The golf ball retriever 10 is large enough to entrap one regulation sized golf ball B as shown in dashed lines in FIG. 5. The wires of the flexible individual looping members 28 as well as the retaining flexible looping element 30 may be made of stainless steel, hard plastic, or other materials of a predetermined thickness so as to have the preferred stiffness characteristics for the present invention, which should provide that stiffness to accomplish the trapping of the ball B by requiring only a minimum contact between the two adjacent flexible individual looping members 28 to trap the ball between them. That is, the flexible individual looping members 28 may be either directly on top of the ball B or on one of the sides of the ball B while coming into initial contact therewith during the retrieving process. As shown in FIG. 5, the ball B is easily moved into the cage element 16. As stated above, and illustrated in FIG. 1, the distance D between the distal portions 34 of the individual looping members 28 is slightly less than the diameter of a regulation sized golf ball, so the individual looping members 28 need only expand slightly in order to capture the golf ball B within the cage element 16. Thus, the golfer need only apply a slight amount of downward pressure upon the cage element 16 in order for the individual looping members 28 to expand around the bottom portions thereof which are in contact with the ball B to form an opening or spacing that permits the passage or wedging of the ball B between the two adjacent capturing loops of the looping members 28.

As soon as the ball B is trapped between the two capturing loops, the flexible individual looping members snap back into their normal looped shapes. Accordingly, the ball B will remain inside the cage 16 until the golfer takes action to remove the ball B therefrom. As illustrated in FIG. 5, during the retrieving process, the cage element 16 is placed over the ball B. The cage element 16 is then lowered to retrieve the ball B. Each of the capturing loops of the flexible individual looping members 28 is within a vertical plane since the loops of the looping elements are vertical before they contact the ball B as shown in dashed lines in FIG. 5. The flexible individual looping members 28 are canted during retrieving the ball B as shown in solid lines in FIG. 5. Once the ball B is retrieved, the capturing loops of the looping members 28 return to their vertical position.

Figure 6:
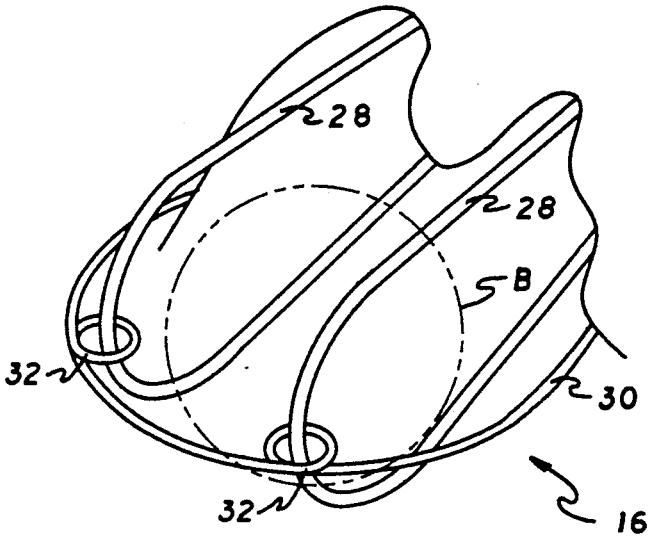
FIG. 6 is a partial perspective view of the cage element of the first embodiment.

As shown in FIGS. 5 and 6, the retaining flexible looping element 30 forms a loop which is substantially in a horizontal position as the cage 16 is lowered over the ball B. Thus, the plane formed by the retaining flexible looping element 30 is perpendicular to both of the planes formed by the capturing loops of the flexible individual looping members 28. If the golfer lifts the cage element 16 up quickly or jerks the cage element 16 up and down while lifting the cage element 16 after the ball B has been retrieved, the ball B could be dropped easily. As discussed above, the stiffness of the individual looping elements 28 and the distance therebetween are established to allow the ball B to be retrieved with minimal effort. The ball B may then be removed with minimal effort. In the preferred method of operation for the golf ball retriever 10, the golfer should rotate the cage 16 by ninety degrees through manipulation of the elongated handle 12 after retrieving the ball B. In this manner the capturing loops of the flexible individual looping members 28 would be in a substantially horizontal position and the loop formed by the retaining flexible loop 30 would be in a substantially vertical position. The retaining flexible loop 30 would then prevent the ball B from falling out of the cage element 16.

Figure 7:
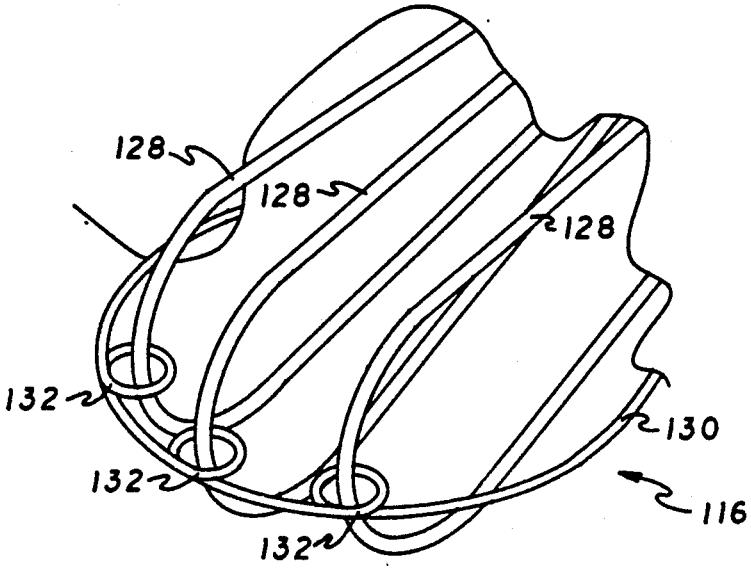
FIG. 7 is a partial perspective view of the cage element of the second embodiment.

The cage element 116 as shown in FIG. 7 performs similar to the cage element 16, except that it is larger and has an additional flexible individual looping element 128. The stiffness of the flexible individual looping members 128 and the retaining flexible looping element 130 is preferably the same as the flexible individual looping members 28 and the retaining flexible looping element 30 and the distance between any two adjacent individual looping members 128 is the same as the distance between the two individual looping members 28. The capturing loops of the individual looping members 128 are maintained in a vertical position as the cage 116 is placed over a regulation size golf ball. The plane defined by the retaining flexible looping element 130 is perpendicular to the plane of the capturing loops. The benefit of the cage element 116 over the cage element 16 is that the golf ball can be captured between any two of the individual looping elements 128, thus less accuracy is required in placing the cage element 116 centered over the golf ball in order to retrieve it. However, the cage element 16 can work in tighter spaces if the golf ball is located within a hole or between two objects.

While it will be apparent that the embodiments of the invention herein disclosed are well calculated to fulfill the objects above-stated, it will be appreciated that the invention is susceptible to modifications, variations, and changes without departing from the proper scope of the appended claims. For example, more than three flexible individual looping members may be used in a cage element.

I claimed:

1. A golf ball retriever for retrieving a regulation golf ball from a hazardous location, comprising;

an elongated handle having a front end thereof;

a cage element attached to said front end, said cage element having a head portion and three flexible individual looping members extending out from said head portion, each one thereof forming a capturing loop about the periphery thereof, each of said three flexible individual looping members fixedly secured to said head portion; and a retaining flexible loop element of said cage element fixedly secured to said head portion, said retaining flexible loop element including three engaging loops, each one of said engaging loops enclosed about each one of said three flexible individual looping members at a distal portion thereof relative to said head portion, wherein, the retaining flexible loop element is within a plane perpendicular to all three planes formed by the capturing loops of the three flexible individual looping members.

2. A golf ball retriever as claimed in claim 1, wherein each of said flexible individual looping members comprise elongated flexible wires whose ends are embedded into a front end of said head portion wherein the spacing between the distal portions of any two adjacent engaging loops is slightly less than the diameter of a regulation golf ball.

3. A golf ball retriever as claimed in claim 1, further comprising angle adjusting means for connecting said head portion of said cage element to said front end of said elongated handle and for allowing the angle between the head portion and the elongated handle to be varied.

4. A golf ball retriever as claimed in claim 3, wherein said angle adjusting means includes two mating grooved portions for defining a swivel connection, wherein one of said mating grooved portions is secured to said front end of said elongated handle and another is rigidly secured to a back end of said head portion.

* * * * *